US006230461B1

(12) United States Patent
Pironi

(10) Patent No.: US 6,230,461 B1
(45) Date of Patent: May 15, 2001

(54) ROOF COVER

(76) Inventor: Vincent Pironi, Crawhez 28, 4890 Thimister-Clermont (BE)

( * ) Notice: Subject to any disclaimer, the term of this patent is extended or adjusted under 35 U.S.C. 154(b) by 0 days.

(21) Appl. No.: 09/367,741

(22) PCT Filed: Feb. 6, 1998

(86) PCT No.: PCT/BE98/00016

§ 371 Date: Aug. 19, 1999

§ 102(e) Date: Aug. 19, 1999

(87) PCT Pub. No.: WO98/38399

PCT Pub. Date: Sep. 3, 1998

(30) Foreign Application Priority Data

Feb. 28, 1997 (BE) ..... 09700180

(51) Int. Cl.[7] ..... E04B 1/00

(52) U.S. Cl. ..... 52/408; 52/411; 52/746.11

(58) Field of Search ..... 52/408, 410, 411, 52/413, 393, 394, 395, 519, 520, 718.04, 746.11, 748.1

(56) References Cited

U.S. PATENT DOCUMENTS

| | | | | |
|---|---|---|---|---|
| 4,519,172 | * | 5/1985 | Ristow . | |
| 4,718,211 | | 1/1988 | Russell et al. . | |
| 5,094,043 | * | 3/1992 | Ristow | 52/222 X |
| 5,479,753 | * | 1/1996 | Williams | 52/746.11 X |
| 5,572,843 | | 11/1996 | Jordan . | |

FOREIGN PATENT DOCUMENTS

| | | |
|---|---|---|
| 2336229 | 2/1975 | (DE) . |
| 528519 | 6/1992 | (EP) . |
| 1335470 | 8/1963 | (FR) . |

* cited by examiner

*Primary Examiner*—Robert W. Gibson, Jr.
(74) *Attorney, Agent, or Firm*—Sughrue, Mion, Zinn, Macpeak & Seas, PLLC

(57) ABSTRACT

The invention concerns a roof cover comprising a synthetic plastic sealing membrane (12) and several synthetic plastic bars (13) arranged parallel to one another on the surface of the sealing membrane. The latter is mechanically fixed to a roof element (11) and each of the bars (13) consists of a single-piece synthetic plastic section, soldered on the sealing membrane (12).

8 Claims, 2 Drawing Sheets

ROOF COVER

FIELD OF THE INVENTION

The present invention relates to the installation of coverings for buildings; in particular, it relates to a novel roof covering.

PRIOR ART

Roof coverings are normally formed using sheets of zinc with butt joints. These zinc coverings have the disadvantage that they expand with heat and become fragile under conditions of severe cold. Moreover, the zinc sheets have to be ventilated from below so as to avoid abnormal ageing. Finally, zinc coverings can only be fastened to timber boards.

DE-A-23362229 and U.S. Pat. No. 5,572,843 disclose roofing systems in which a sealing membrane of synthetic material is spread over the roof, said membrane being secured by means of flat bars or section members of synthetic material. However, these bars or section members do not impart to a roof covered in this way an aesthetic appearance similar to that of a conventional zinc roofing.

SUMMARY OF THE INVENTION

The invention proposes a system for covering a roof, comprising a sealing membrane of synthetic material and a plurality of bars of synthetic material arranged parallel to one another on the surface of the sealing membrane. The latter is mechanically secured to a roofing element and each of the bars comprises a section member in one piece consisting of synthetic material welded to the sealing membrane. The base of each section member is welded to the sealing membrane 12 using any suitable process.

In a preferred embodiment each section member is formed with a base and a projecting web surmounted by a portion which has profile of generally triangular shape having a rounded crest.

In addition to making it possible to provide roof coverings which do not have the drawbacks of zinc coverings, the roof covering according to the invention also has the following advantages:

(i) the roofing can be effected more easily and more rapidly than zinc roofings with butt joints;

(ii) large choice for the covering support;

(iii) reduction in the cost of the roofing in relation to a zinc covering with butt joints;

(iv) the appearance of the covering is substantially similar to that of a conventional zinc covering.

The invention will be described in more detail below with reference to the accompanying drawings.

DESCRIPTION OF THE EMBODIMENT OF THE INVENTION

Figure 1:
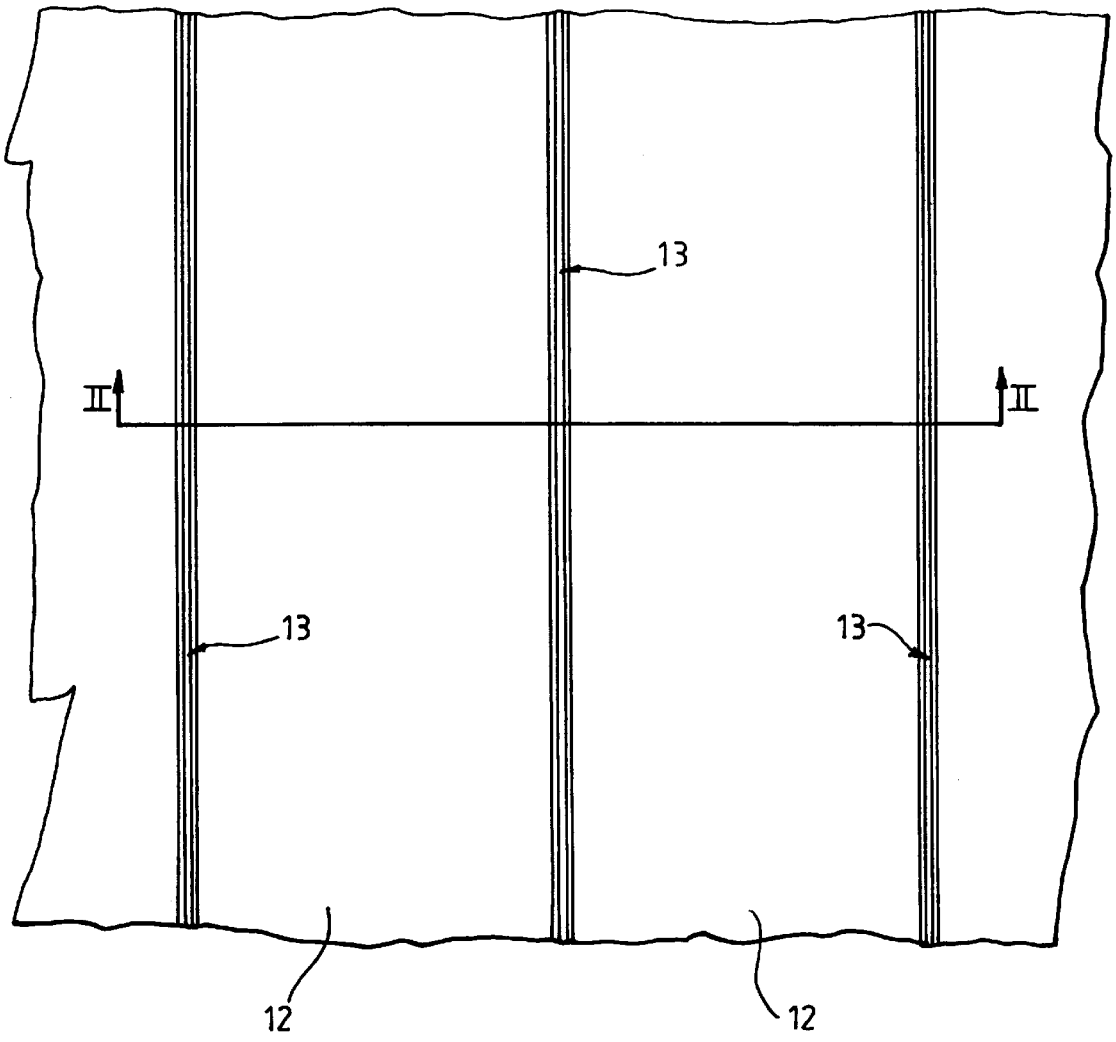
FIG. 1 is a view from above of a roof surface covered in accordance with the invention.
Figure 2:
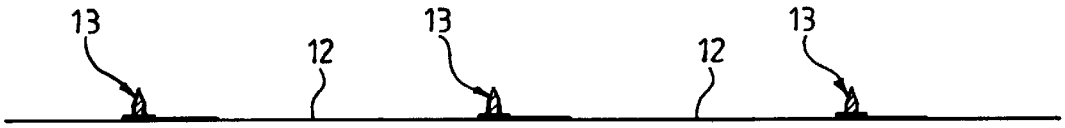
FIG. 2 shows a section along the line II—II in FIG. 1.

A uniform sealing membrane comprising sheets 12 of PVC, for example, is secured mechanically using any means on to the surface of a roof element 11, for example an insulating material, battening, concrete, a metal sheet, etc.

Section members in one piece 13 of synthetic material are fitted on to this membrane 12, for example flexible PVC section members disposed parallel to one another at a regular distance apart. The section members 13 are secured to the membrane 12 by welding, for example by cold welding using tetrahydrofuran or by hot air welding.

Figure 3:
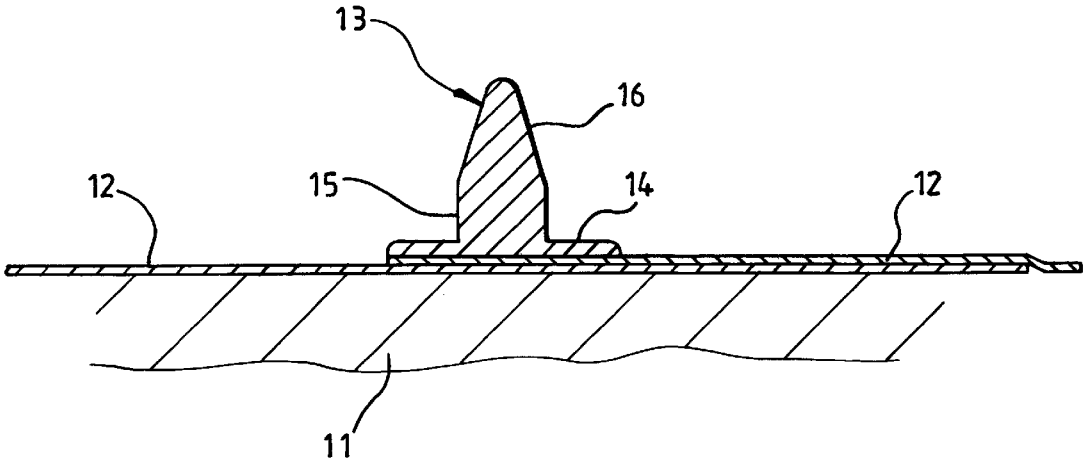
FIG. 3 is an enlarged view of a section member illustrated in FIG. 2.

In the example illustrated in FIG. 3, the section members 13 comprise a base 14 and a projecting web 15 surmounted by a portion 16 having a cross-section of generally triangular shape. The web 15 of the section member has, for example, a width of approximately 1 cm and a height of approximately 3 cm. In the embodiment shown in FIG. 3 the section members 13 are fastened in the overlapping zone of two consecutive sheets of PVC 12, which has the effect of rendering the joints invisible. The appearance of a roof covering formed in this way in a simple and rapid manner is similar to that of a conventional roof covering.

What is claimed is:

1. A system for covering a roof, comprising a sealing membrane (12) of synthetic material and a plurality of bars (13) of synthetic material arranged parallel to one another on the surface of the sealing membrane, characterised in that the sealing membrane (12) is mechanically secured to a roofing element (11) and each of the bars (13) comprises a section member in one piece consisting of synthetic material welded to the sealing membrane (12).

2. A system for covering a roof according to claim 1, characterised in that each section member (13) is formed with a base (14) and a projecting web (15) surmounted by a portion (16) having a cross-section of generally triangular shape.

3. A system for covering a roof according to claim 2, characterised in that said portion (16) has a rounded crest (17).

4. A system for covering a roof according to claim 2, characterised in that the base (14) of each section member (13) is welded to the sealing membrane (12).

5. The system for covering a roof according to claim 2, characterized in that the base (14) of each section member (13) is welded to an overlapping zone of two consecutive sealing sheets or strips (12) of said sealing membrane.

6. A system for covering a roof according to claim 3, characterised in that the base (14) of each section member (13) is welded to the sealing membrane (12).

7. The system for covering a roof according to claim 3, characterized in that the base (14) of each section member (13) is welded to an overlapping zone of two consecutive sealing sheets or strips (12) of said sealing membrane.

8. The system for covering a roof according to claim 1, wherein said sealing membrane is flat and is secured directly to the roofing element, and wherein each said section member is welded directly to said sealing membrane.

* * * * *